US005411246A

United States Patent [19]

Nonomura et al.

[11] Patent Number: 5,411,246

[45] Date of Patent: * May 2, 1995

[54] PAPER FEEDER

[75] Inventors: Tomohiro Nonomura; Hiroshi Kishimoto, both of Hyogo, Japan

[73] Assignee: Fujitsu Limited, Kawasaki, Japan

[ * ] Notice: The portion of the term of this patent subsequent to Aug. 9, 2011 has been disclaimed.

[21] Appl. No.: 98,820

[22] Filed: Jul. 29, 1993

Related U.S. Application Data

[63] Continuation-in-part of Ser. No. 11,727, Feb. 1, 1993, Pat. No. 5,335,901.

[30] Foreign Application Priority Data

Jan. 19, 1993 [JP] Japan ..... 5-007028
Mar. 25, 1993 [JP] Japan ..... 5-066984

[51] Int. Cl.[6] ..... B65H 3/06

[52] U.S. Cl. ..... 271/117; 271/126; 271/155; 271/157

[58] Field of Search ..... 271/117, 118, 126, 152, 271/153, 155, 157, 147

[56] References Cited

U.S. PATENT DOCUMENTS

| | | | |
|---|---|---|---|
| 4,482,148 | 11/1984 | Stewart | 271/273 |
| 4,552,352 | 11/1985 | Nickels et al. | 271/117 |
| 5,150,893 | 9/1992 | Uno et al. | 271/157 |
| 5,305,996 | 4/1994 | Taniwa et al. | 271/126 |

FOREIGN PATENT DOCUMENTS

| | | | |
|---|---|---|---|
| WO86/07339 | 12/1972 | Australia . | |
| 0139790 | 5/1985 | European Pat. Off. . | |
| 2217924 | 12/1972 | Germany . | |
| 3642155A1 | 6/1988 | Germany . | |
| 0212623 | 9/1988 | Japan | 271/155 |
| 0043133 | 2/1990 | Japan | 271/152 |
| 0163228 | 6/1990 | Japan | 271/145 |
| 0243425 | 9/1990 | Japan | 271/157 |
| 5132159 | 5/1993 | Japan | 271/157 |
| 2190363A | 11/1987 | United Kingdom . | |

OTHER PUBLICATIONS

Patent Abstracts of Japan, Publciation No. JP 2043133, Date: 13 Feb. 1990 Title: Large Volume Paper Feeding Device.

Patent Abstracts of Japan, Publciation No. JP 2243429, Date: 27 Sep. 1990 Title: Paper Feeder.

Patent Abstracts of Japan, Publciation No. JP 2243425, Date: 27 Sep. 1990 Title: Paper Feeder.

Patent Abstracts of Japan, Publciation No. JP 57131644, ate: 14 Aug. 1982 Title: Recording Material Carrier.

*Primary Examiner*—H. Grant Skaggs

*Attorney, Agent, or Firm*—Nikaido, Marmelstein, Murray & Oram

[57] ABSTRACT

A paper feeder capable of reducing its installation space and manufacturing cost, wherein a paper feed table which can be lifted or lowered being held horizontal is provided with an opening section. In order to load paper sheets onto the paper feed table directly from above, the opening section is made openable at the upper part thereof when the paper feeder is in a paper feeding state during which paper sheets are picked up and fed to a photosensitive drum or other device. The paper feeder also has a pick-up member for picking up the paper sheets thus loaded onto the paper feed table one after another starting with the top sheet in order to feed them to the photosensitive drum or other device.

26 Claims, 5 Drawing Sheets

PAPER FEEDER

CROSS REFERENCE TO RELATED APPLICATIONS

This patent application is a continuation-in-part application of U.S. Ser. No. 08/011,727 filed on Feb. 1, 1993, and now U.S. Pat. No. 5,335,901.

BACKGROUND OF THE INVENTION (1) Field of the Invention

The present invention relates to a paper feeder for use with various types of electrophotographic devices such as, for example, facsimiles, printers or copying machines, in which paper sheets stacked on the paper feed table are picked up and fed one after another, starting with the top sheet.

(2) Description of the Prior Art

In recent years, in order to meet the demand-for higher capacity of paper feeders which has been growing with the increase in the speed of the printing process, a paper feeder in which paper sheets are replenished in the following manner is widely used for :Feeding paper sheets to such an electrophotographic device as mentioned above.

For replenishment of paper sheets, the paper feed table, which is housed in the paper feeder and can be lifted or lowered with paper sheets stacked thereon, is firstly lowered to the lowest position and pulled forwards with the help of sliding rails or similar devices. Then, paper sheets are loaded onto the paper feed table thus pulled out. After the loading, the paper feed table is pushed back with the help of the sliding rails and housed in the paper feeder.

SUMMARY OF THE INVENTION

Such a paper feeder of the so-called pulling-out type requires a space for accommodating the paper feed table which has been pulled forwards and this could be a problem in saving the installation space. It also has a problem in saving the manufacturing cost. Because, such a paper feeder requires not only sliding rails or the like in order to pull the paper feed table out of the paper feeder and push it back thereto, but also a link mechanism which is used for connecting the paper feed table with the driving mechanism for lifting or lowering the paper feed table and disconnecting the former from the latter, such connection/disconnection taking place when the paper feed table is pulled out of the paper feeder, or when it is pushed back thereto.

The prime object of the invention is therefore to provide a paper feeder with which not only the installation space but also the manufacturing cost can be saved by overcoming the above disadvantages.

In order to accomplish the foregoing object, a paper feeder according to the invention comprises:

(a) an opening section having an upper part which is openable when the paper feeder is in a paper feeding state during which paper sheets are picked up and fed;

(b) a paper feed table which can be lifted towards the opening section or lowered therefrom being held horizontal and onto which paper sheets are loaded from above through the opening section; and (c) a pick-up member for picking up the paper sheets stacked on the paper feed table one after another for feeding, starting with a top sheet.

With the above paper feeder, the replenishment of paper sheets is carried out in such a way: paper sheets are loaded from above onto the paper feed table that can be lifted towards the opening section or lowered therefrom being held horizontal, through the opening section the upper part of which is openable when the paper feeder is in its paper feeding state during which the paper sheets are picked up and fed. The paper sheets thus loaded onto the paper feed table are picked up one after another by the pick-up member starting with the top sheet, in order to feed to a photosensitive drum or other devices.

With the above arrangement, the paper sheets to be replenished can be directly loaded from above onto the paper feed table through an opening section the upper part of which is openable when the paper feeder is in its paper feeding condition. This arrangement eliminates the need for a space required in conventional devices In order to accommodate the paper feed table which has been pulled forwards as well as the need for sliding rails etc., and therefore, the installation space and manufacturing cost can be saved.

In cases where at least a part of the pick-up member projects over the paper sheets stacked on the paper feed table, it is preferable that the part of the pick-up member can be retracted from the position above the paper feed table. In cases where at least a part of a paper presence/absence detector for detecting the presence or absence of paper sheets on the paper feed table similarly projects over the stacked paper sheets on the paper feed table, the part of the paper presence/absence detector is preferably retractable from the position above the paper feed table together with the retraction of the part of the pick-up member from the position above the paper feed table. Such a retraction arrangement facilitates loading of paper sheets onto the paper feed table from above.

In cases where the opening section is provided with an openable cover, it is preferable that at least the projecting parts of the pick-up member and the paper presence/absence detector can be retracted From their respective projecting positions above the paper feed table concomitantly with the opening of the openable cover. The above-mentioned projecting part of the pick-up member may be a pick up roller and the projecting part of the paper presence/absence detector may be a paper absence detection lever. This paper absence detection lever downwardly pivots about the axis of a shaft disposed on a side of the paper feed table so that its tip portion is fitted into a hole defined at the paper feed table, when there is no paper sheet on the paper feed table.

Concretely, the retraction of the pick-up roller and the retraction of the paper absence detection lever, which are concomitant with the opening of the openable cover, are done in the following manner:

1. The shaft disposed on a side of the paper feed table, for supporting the pick-up roller so as to inhibit the forward and backward rotations of the pick-up roller is rotated, whereby the pick-up roller is allowed to pivot upwardly about the axis of the shaft concomitantly with the opening of the openable cover with the help of a link mechanism;

2. The shaft disposed on a side of the paper feed table, for supporting the paper absence detection lever so as to allow its forward and backward rotations and the pick-up roller so as to inhibit Its forward and backward rotations is rotated, whereby the pick-up roller pivots upwardly about the axis of the shaft concomitantly with the opening of the openable cover with the help of the link mechanism, whilst the paper absence detection lever pivots upwardly, being engaged with the upwardly pivoting pick-up roller.

In cases where paper sheets are loaded from above onto the paper feed table through the opening section which is openable when the paper feeder is in its paper feeding state during which paper sheets are picked up and fed, the paper feeder preferably comprises:

(a) holding means for holding the paper feed table such that the paper feed table can be lifted or lowered being held horizontal;

(b) feeding level maintaining means for lifting the paper feed table held horizontal by the holding means, for paper feeding, such that a top sheet of paper sheets stacked on the paper feed table is kept at a predetermined feeding level; and (c) loading level maintaining means for lowering the paper feed table held horizontal by the holding means, for loading, such that when paper sheets are not stacked on the paper feed table, the paper feed table is kept at a predetermined loading level that is lower than the feeding level and such that when paper sheets are stacked on the paper feed table, the top sheet of the stacked paper sheets is kept at the loading level, whereby paper sheets to be replenished can be loaded onto the paper feed table at the loading level.

Accordingly, when loading paper sheets from above onto the paper feed table through the opening section, the loading can be performed at a predetermined loading level that is lower than a predetermined feeding level. More specifically, when there is no paper sheet on the paper feed table, paper sheets are loaded onto the paper feed table maintained at the predetermined loading level by the loading level maintaining means. On the other hand, when there are paper sheets stacked on the paper feed table, another supply of paper sheets is placed on the top sheet of the stacked paper sheets, the top sheet being maintained at the loading level by the loading level maintaining means. Thus, the stacking of paper sheets on the paper feed table can be carried out in a stable condition, thereby facilitating the replenishment operation.

One preferred embodiment of the holding means includes an endless rope at least on each of opposite sides of the paper feed table. Each of the endless ropes is extended in figure-of-eight fashion so as to form vertical portions on a plane parallel with an ascending/descending plane of the paper feed table. The paper feed table is horizontally suspended being secured to the vertical portions of the extended endless ropes, whereby the paper feed table can be so supported as to be lifted or lowered being kept in a horizontal condition. The endless ropes are wound around a plurality of pairs of pulleys in figure-of-eight fashion on the respective sides of the paper feed table. The pulleys constituting a pair are arranged in a vertical direction and a plurality of such pulleys are aligned on both sides of the paper feed table.

In one preferred embodiment of the feeding level maintaining means, an endless rubber belt serves as a belt member. Such feeding level maintaining means comprises:

(a) endless rubber belt(s) extended on a side face of the paper feed table in the ascending/descending directions thereof and (each) including an engaging member which is brought into engagement with the underside of the paper feed table; and (b) a driving mechanism for driving the endless rubber belt(s) in the ascending/descending directions of the paper feed table. During paper feeding, the driving mechanism actuates the endless rubber belt(s), with the engaging member(s) of it(them) being engaged with the underside of the paper feed table in order to lift the paper feed table such that the top sheet of paper sheets stacked thereon is maintained at the predetermined feeding level.

In one preferred embodiment of the loading level maintaining means, a tension coil spring serves as an elastic member. Such loading level maintaining means comprises a tension coil spring for imparting an elastic tension force in the ascending direction of the paper feed table. During loading of paper sheets, the paper feed table is lowered against the elastic tension force of the tension coil spring while paper sheets being loaded, whereby when there is no paper sheet on the paper feed table, the paper feed table is kept at the predetermined loading level and whereby when there are paper sheets stacked on the paper feed table, the top sheet of the stacked paper sheets is kept at the predetermined loading level.

Preferably, the openable cover is a two-foldable cover, and such a two-foldable cover is composed of two half covers, i.e., a first half cover and a second half cover. The first and second half covers are engaged with each other at their first sides such that they can pivot about an axis extending along the first sides. The second half cover is engaged with the main body of the paper feeder at a second side which is opposite to its first side such that the second half cover can pivot about an axis extending along the second side. It is preferable that the two-foldable cover described above is opened and kept in an opening condition in the following manner.

1. For opening the two-foldable cover, the first half cover is raised and then the first half cover is moved towards the second half cover, by sliding a second side (opposite to the first side) of the first half cover on an end face of the main body of the paper feeder so that the rear face of the first half cover comes to face to the rear face of the second half cover.

2. When the two-foldable cover is in its opening condition, the second half cover stands substantially upright, being prevented from pivoting in the cover-opening direction in relation to the main body of the paper feeder, whilst the first half cover inclines in the cover-opening direction and leans against the raised second half cover, being supported at the first side-thereof, whereby the opening conditions is maintained.

With the above arrangement, the opening/closing of the openable cover can be carried out with ease and eliminates the need for expensive members such as gas-springs. Also, the first half cover supports the second half cover in order to prevent the fall-down of the second half cover, thereby ensuring the stability of the openable cover. Further, the first and second half covers have the same shape and are symmetrically disposed to pivotally engage with each other, whereby equalization of components can be expedited leading to cost reduction.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
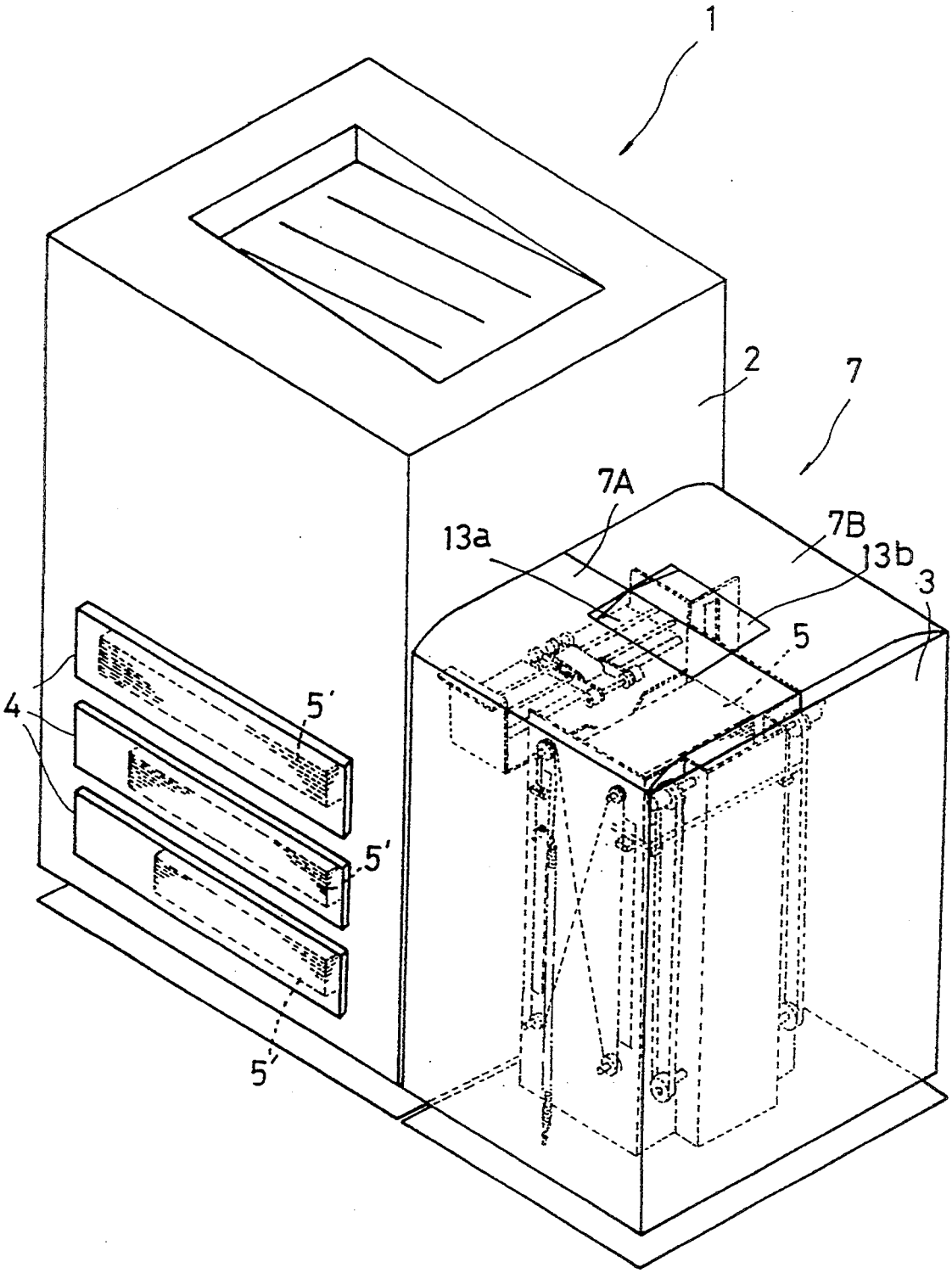
FIG. 1 is a view showing a paper feeder in service according to an preferred embodiment of the invention, the paper feeder being of the separation type installed together with an electrophotographic device.

Referring now to the drawings, preferred embodiments of a paper feeder according to the invention will be hereinafter described.

FIG. 1 shows a main body 2 of an electrophotographic device 1 such as a facsimile, printer or copying machine, and a paper feeder 3 to which the invention is applied. The paper feeder 3 is of the separation type which is constructed separately from the electrophotographic device body 2, and when it is used, it is installed together with the electrophotographic device body 2 as shown in FIG. 1. The electrophotographic device body 2 of the electrophotographic device 1 is also provided with a paper feed tray 4 composed of three cassettes. A stack of paper sheets 5 is stored in the paper feeder 3 and another stack of paper sheets 5' in the paper feed tray 4. Either of the stacks 5, 5' being selected, the paper sheets 5 (5') are sequentially picked up starting with the top sheet and fed to a photosensitive drum (not shown) or other device incorporated within the electrophotographic device body 2. Thereafter, with a known electrophotographic procedure, desired images are transferred by means of the photosensitive drum etc. onto the paper sheets which have been fed, and thus printing, copying etc. are executed.

Figure 2:
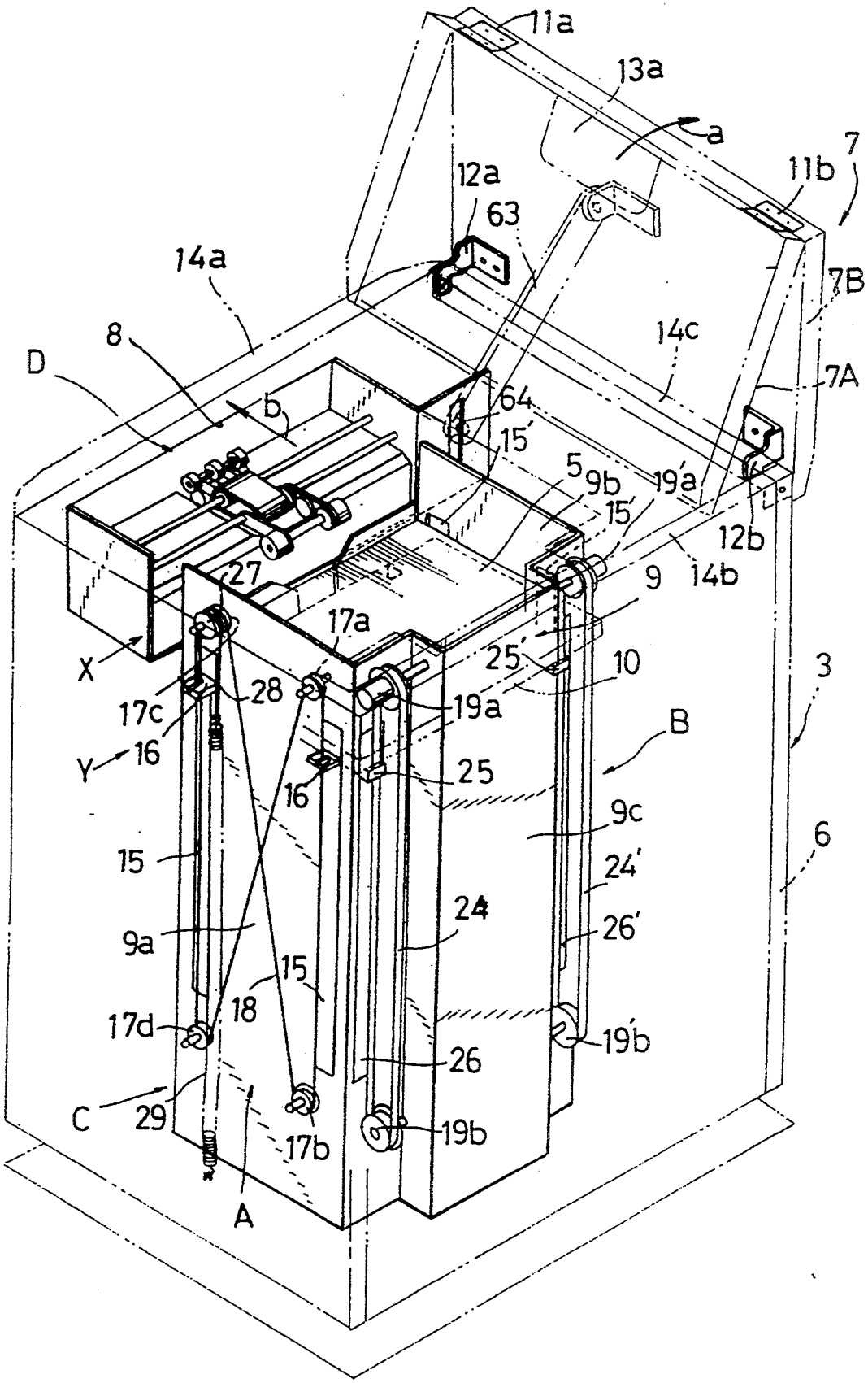
FIG. 2 is a perspective view of the whole construction of the paper feeder of the invention.

In FIG. 2, the paper feeder 3 to which the invention is applied has a casing 6 at the upper face of which is formed an opening section 8. Disposed over the opening section 8 is an openable cover 7 configured in a two-foldable structure, so that the opening section 8 can be opened at the upper part thereof when the paper feeder 3 is in its paper feeding condition (as shown in FIG. 1) during which the paper sheets are picked up and fed to the electrophotographic device body 2. Incorporated within the casing 6 is a paper hopper 9 that is open at the upper part thereof. A paper feed table 10 is loosely fitted in the paper hopper 9 in a horizontal condition. There are the paper sheets 5 of a specified size (e.g., A4-size) stacked on the paper feed table 10.

The openable cover 7 in a two-foldable structure is composed of a front cover 7A and a rear cover 7B. There are provided a pair of hinges **11*a*, 11*b* bolted onto first sides (i.e., the upper sides in FIG. 2) of the respective front and rear covers 7A and 7B so that the front and rear covers 7A and 7B are so coupled to each other as to pivot about an axis extending along their first sides. At a second side of the rear cover 7B (the second side is the lower side in FIG. 2 and opposite to the first side of the rear cover 7B), there are disposed a pair of mounting brackets 12*a*, 12*b* which are bolted to the rear cover 7B and pivotally supported on the casing 6 incorporated in the main body of the paper feeder 3. By means of the mounting brackets 12*a*, 12*b*, the rear cover 7B is so engaged with the casing 6 as to pivot about an axis extending along the second side. In order to pivotally support the mounting brackets 12*a*, 12*b*, the mounting brackets 12*a*, 12*b* are formed to have convexities whilst the casing 6 has concavities to receive the convexities. In order to raise the front and rear covers 7A, 7B, these covers 7A, 7B are provided with handles 13*a*, 13*b* operable by hand, as particularly shown in FIG. 1**.

For opening the paper feeder 3 that is in a closed condition as shown in FIG. 1, the handle **13*a* on the front cover 7A is pulled by hand to raise the front cover 7A. Then, the front cover 7A is moved towards the rear cover 7B such that the second side (lower side) of the front cover 7A slides on the upper end faces 14*a*, 14*b* of the casing 6 which are located on the right/left sides of the casing 6 with respect to the front and rear covers 7A, 7B, until the rear face of the front cover 7A comes to face to the rear face of the rear cover 7B. By carrying out the above-described operation, the rear cover 7B pivots in the opening direction a shown in FIG. 2 in relation to the casing 6, with the help of the mounting brackets 12*a*, 12*b* and stands upright. When the rear cover 7B stands upright, the lower end faces of the pair of mounting brackets 12*a*, 12*b* come in contact with the upper end face 14*c* of the casing 6, thereby preventing the further pivoting of the rear cover 7B in the opening direction a. Meanwhile, the front cover 7A inclines in the opening direction a and leans against the raised rear cover 7B, being supported at the first (upper) side thereof so that the rear cover 7B is prevented from falling down and the openable cover 7 is accordingly kept in its opening condition. When closing the openable cover 7, the above-described procedure is carried out in reverse order and therefore the closing procedure will not be described. The handle 13*b* disposed on the rear cover 7B is formed in the same mold as that of the handle 13*a* only for the reason that the front cover 7A and the rear cover 7B can be made up of the same components, and therefore the handle 13*b* does not necessarily function to achieve the same effect as that of the handle 13A of the front cover 7A**.

The paper feed table 10 is provided with the following mechanisms:

(1) a holding mechanism A for holding the paper feed table 10 such that it can be lifted or lowered being held horizontal;

(2) a feeding level maintaining mechanism B for lifting the paper feed table 10, for paper feeding, such that the top sheet of the paper sheets 5 stacked thereon is maintained at a feeding level indicated by the arrow X in FIG. 2;

(3) a loading level maintaining mechanism C for lowering the paper feed table 10, for loading, such that when there is no paper sheet on the paper feed table 10, the paper feed table 10 is kept at a loading level indicated by the arrow Y in FIG. 2 that is lower than the feeding level X; and such that when there are the paper sheets 5 stacked on the paper feed table 10, the top sheet of the paper sheets 5 is kept at the loading level Y, whereby paper sheets to be replenished can be loaded onto the paper feed table 10 at the loading level Y.

There is provided a pick-up mechanism D on the paper feeding side of the paper feeder, adjacent to the opening of the paper hopper 9. The pick-up mechanism D picks up the paper sheets 5 stacked on the paper feed table 10 one after another starting with the top sheet and feeds them to the electrophotographic device body 2. There are also provided a paper presence/absence detector (not shown) for detecting whether or not paper sheets are stacked on the paper feed table 10, and a feeding level detector (not shown) which constitutes a part of the feeding level maintaining mechanism B and has the function of detecting whether or not the top sheet of the paper sheets 5 stacked on the paper feed table 10 is kept at the feeding level X.

Figure 3:
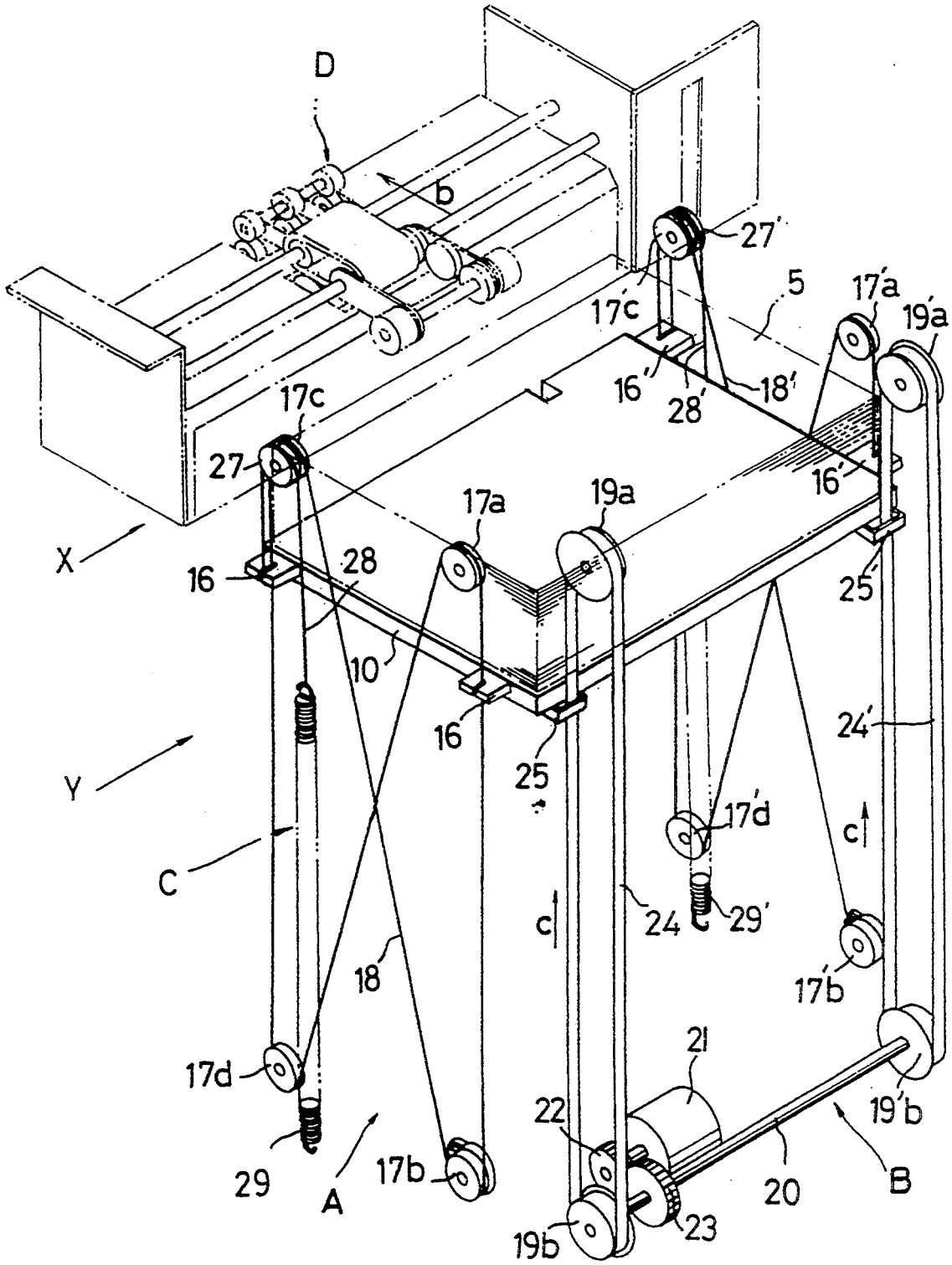
FIG. 3 is a schematic view of the mechanism of the paper feeder of the invention.

In order to describe the holding mechanism A, the feeding level maintaining mechanism B and the loading level maintaining mechanism C in that order, reference is now made to FIG. 2 and further to FIG. 3 which schematically shows those mechanisms.

(1) Holding mechanism A

There are provided a pair of guide grooves 15 piercing a side wall 9*a* of the paper hopper 9 and another pair of guide grooves 15' piercing a side wall 9*b* of the paper hopper 9, these side walls 9*a*, 9*b* being situated at the right and left with respect to the paper feeding direction b. The guide grooves 15 (15') are aligned in the paper feeding direction b, each extending in a vertical direction. Projections 16 (16') are provided on each side of the paper feed table 10 loosely fitted in the paper hopper 9, so as to correspond to the guide grooves 15 (15'), the sides being situated at the right and left of the paper feeding direction b. Those projections 16 (16') project from the paper feed table 10, being loosely inserted into the corresponding guide grooves 15 (15'). Each of the side walls 9*a*, 9*b* of the paper hopper 9 is provided with pulleys 17*a* to 17*d* (17*a'* to 17*d'*) fixedly attached to the outer face thereof. Specifically, the pulleys in each pair are vertically aligned and two pairs of pulleys 17*a* and 17*b* (17*a'* and 17*b'*); 17*c* and 17*d* (17*c'* and 17*d'*) are aligned in the paper feeding direction b. An endless wire rope 18 (18') is extended, being wound around those pairs of pulleys 17*a* to 17*d* (17*a'* to 17*d'*) in figure-of-eight fashion so as to form vertical portions on a plane parallel with an ascending/descending plane of the paper feed table 10. The paper feed table 10 is suspended being fixed in a horizontal condition at the vertical portions of the extended endless wire rope 18 (18') by means of the projections 16 (16').

This allows the paper feed table 10 to be lifted to or lowered from the opening section 8, being kept in a horizontal condition.

(2) Feeding level maintaining mechanism B

The paper hopper 9 is provided with two pairs of pulleys 19*a*, 19*b*; 19*a'*, 19*b'* at the outer face of a rear wall 9*c*, the rear wall 9*c* being situated on a side opposite to the paper feeding side. Specifically, the pulleys in each pair are aligned vertically. The pair of pulleys 19*a*, 19*b* is situated at the left; the pair of pulleys 19*a'*, 19*b'* is at the right with respect to the paper feeding direction b. Of those pulleys 19*a*, 19*b*, 19*a'* and 19*b'*, the upper pulleys 19*a*, 19*a'* are independently fixed to the rear wall 9*c* of the paper hopper 9 whilst the lower pulleys 19*b*, 19*b'* are coupled to each other by a common rotary shaft 20. The rotary shaft 20 is so supported at the rear wall 9*c* of the paper hopper 9 as to rotate in forward and backward directions. The rotary shaft 20 is provided with a coaxial gear 23 which meshes with a gear 22 of a driving motor 21 so that the forward and backward rotations of the driving motor 21 are transmitted to the pulleys 19*b*, 19*b'*. An endless rubber belt 24 is extended being wound around the pair of vertically aligned pulleys 19*a*, 19*b*, and another endless rubber belt 24' is extended being wound around the pair of vertically aligned pulleys 19*a'*, 19*b'*. The endless rubber belts 24, 24' have engaging pieces 25, 25' respectively. Those engaging pieces 25, 25' project from the endless rubber belts 24, 24', being loosely inserted into a pair of guide grooves 26, 26' respectively so that they can engage with the underside of the paper feed table 10. The guide grooves 26, 26' are defined at the right and left of the paper feeding direction piercing the rear wall 9*c* of the paper hopper 9 such that they correspond to the engaging pieces 25, 25' respectively and extend vertically.

For paper feeding, the driving motor 21 forwardly rotates, thereby moving the endless rubber belts 24, 24' in a forward direction c shown in FIG. 3. This movement causes the engaging pieces 25, 25' attached to the endless rubber belts 24, 24' to move upwards and then be brought into engagement with the underside of the paper feed table 10. The paper feed table 10 engaged with the engaging pieces 25, 25' is lifted until the feeding level detector detects that the top sheet of the paper sheets 5 stacked on the paper feed table 10 has reached the feeding level X and the driving motor 21 is stopped. As the paper sheets 5 are picked up, the driving motor 21 is actuated in the forward direction, based on the detection by the feeding level detector as to whether or not the top sheet is positioned at the feeding level X, and the paper feed table 10 is lifted such that the top sheet is maintained at the feeding level X.

(3) Loading level maintaining mechanism C

The paper hopper 9 is provided with pulleys 27, 27' which have the same axes as those of the pulleys 17, 17' of the holding mechanism A respectively, the pulleys 17, 17' being located at upper positions (close to the paper feeding side) on the respective outer faces of the right and left side walls 9*a*, 9*b* of the paper hopper 9. Wound around the pulley 27 (27') is a wire rope 28 (28') one end of which is so suspended as to be secured to the projection 16 (16') of the paper feed table 10. The other end of the wire rope 28 (28') is suspended so as to be connected to one end of a tension coil spring 29 (29'). The other end of the tension coil spring 29 (29') is fixed to the bottom of the casing 6. The tension coil spring 29 (29') has a spring constant with which a lifting force is applied to the paper feed table 10 such that when there is no paper sheet on the paper feed table 10, the paper feed table 10 is maintained at the loading level Y and such that when there are paper sheets stacked on the paper feed table 10, the top sheet of the stacked paper sheets 5 is maintained at the loading level Y.

For loading paper sheets, the driving motor 21 of the feeding level maintaining mechanism B is actuated in the backward direction, thereby moving the endless rubber belts 24, 24' in a direction opposite to the forward direction c shown in FIG. 3. This causes the engaging pieces 25, 25' attached to the endless rubber belts 24, 24' to be lowered so that the engaging pieces 25, 25' are released from the engagement with the paper feed table 10. Consequently, the paper feed table 10 is lowered until the paper feed table 10 reaches the loading level Y when there is no paper sheet stacked thereon or until the top sheet of the stacked paper sheets 5 reaches the loading level Y when there are paper sheets stacked on the paper feed table 10. Upon completion of the loading of the paper sheets onto the paper feed table 10, the paper feed table 10 is lowered again so that the top sheet of the loaded paper sheets comes to the loading level Y.

Figure 4:
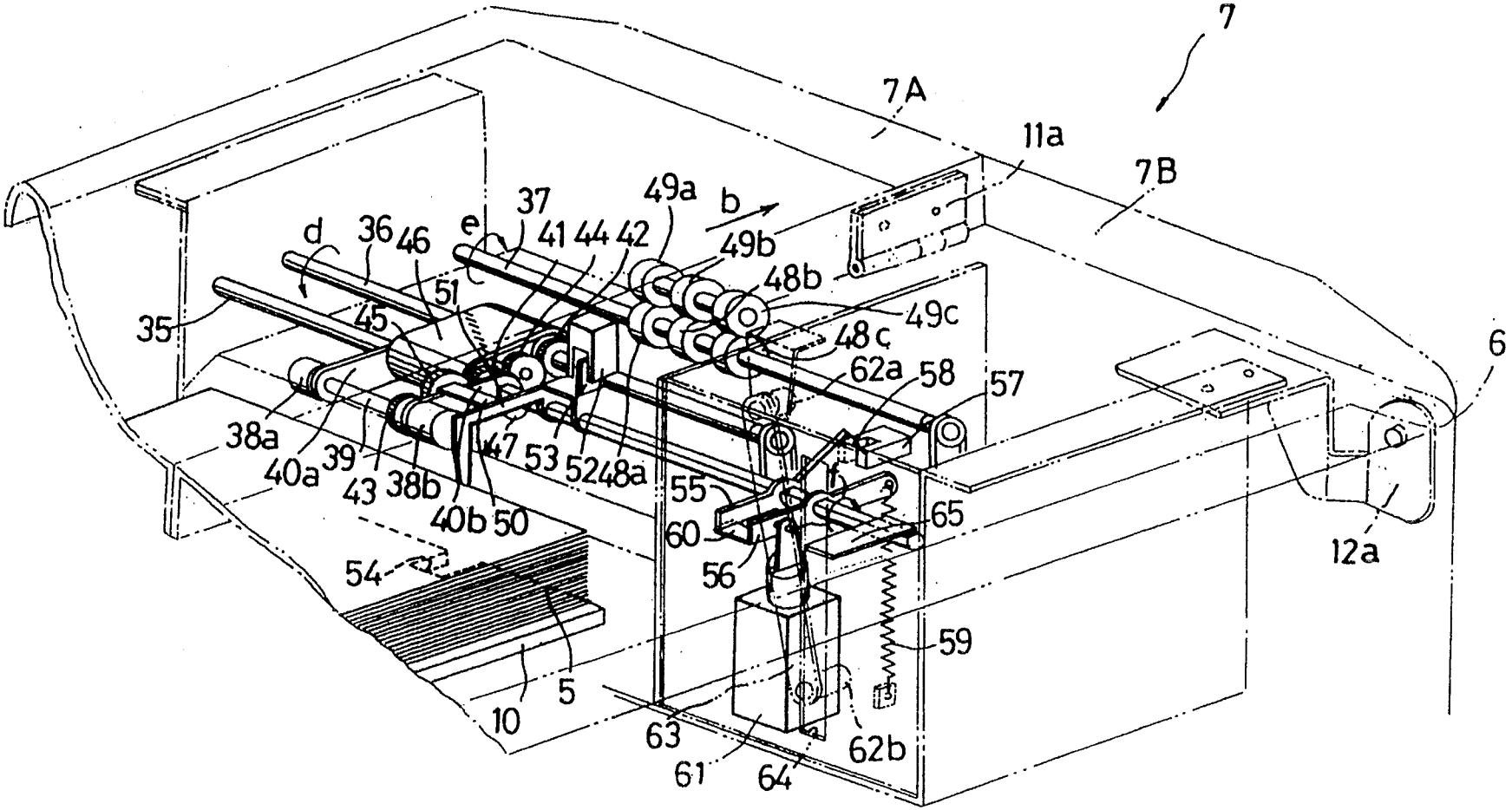
FIG. 4 is a partially enlarged perspective view of FIG. 2.

With reference to FIG. 4 showing a partially enlarged perspective view, the pick-up mechanism D, the paper presence/absence detector, the feeding level detector will be described in that order.

(a) Pick-up mechanism D

On the paper feeding side, there are a first rotary shaft 35, a second rotary shaft 36, a third rotary shaft 37 disposed in order in the paper feeding direction b viewed from the paper feed table 10. The second rotary shaft 36 and the third rotary shaft 37 are driven by different driving motors (not shown). The first to third rotary shafts 35, 36, 37 are so supported on the side of the casing 6 as to rotate in the forward and backward directions. The first rotary shaft 35 is provided with a pair of pick-up rollers 38*a*, 38*b* which project over the paper sheets stacked on the paper feed table 10 and are brought into contact with the top sheet from above by their own weight, when they are in operation. The pick-up rollers 38*a*, 38*b* have a common rotary shaft 39 which is supported by supporting arms 40*a*, 40*b* at respective ends of the arms 40*a*, 40*b* so as to rotate forwardly and backwardly, and the other ends of the supporting arms 40*a*, 40*b* are secured to the first rotary shaft 35, whereby the pick-up rollers 38*a*, 38*b* are supported by the first rotary shaft 35 with the help of the supporting arms 40*a*, 40*b* so as not to rotate forwardly and backwardly in relation to the first rotary shaft 35. The rotary movement is transmitted in turn from the second rotary shaft 36 to the pick-up rollers 38*a*, 38*b* by way of gears 41 to 43 secured to the first and second rotary shafts 35, 36 and the common rotary shaft 39, and intermediate gears 44, 45 that are disposed between the gears 41 to 43, being in mesh therewith. An endless feed belt 46 is extended, being wound around the first and second rotary shafts 35, 36 such that the endless feed belt 46 slides freely in relation to the first rotary shaft 35. A driven roller 47 is disposed facing to the underside of the endless feed belt 46. Three delivery rollers 48*a* to 48*c* are secured to the third rotary shaft 37, and driven rollers 49*a* to 49*c* are disposed over the delivery rollers 48*a* to 48*c*, facing thereto.

The second and third rotary shafts 36, 37 are intermittently rotated in the direction of the arrow d and the direction of the arrow e as shown in the drawings respectively by means of the aforesaid different driving motors in such a manner that the latter rotates slower than the former. With such an arrangement, the paper sheets stacked on the paper feed table 10 are picked up, from the top sheet by means of the pick-up rollers 38*a*, 38*b*. After being picked up, the paper sheets are gripped between the endless field belt 46 and the driven roller 47 and then between the delivery rollers 48*a* to 48*c* and the driven rollers 49*a* to 49*c* so as to be delivered to the electrophotographic device body 2.

(b) Paper presence/absence detector

The first rotary shaft 35 is also provided with a paper absence detection lever 51 that is so supported as to rotate forwardly and backwardly in relation to the first rotary shaft 35. The paper absence detection lever 51 has an engaging piece 50 integrally formed therewith. The engaging piece 50 is able to come in contact with the upper end (shown in FIG. 4) of the supporting arm 40*b* from above, the supporting arm 40*b* being one of the arms which support the common rotary shaft 39 of the pick-up rollers 38*a*, 38*b*, and this contact permits the engaging piece 50 to be engaged with the supporting arm 40*b*. A paper absence sensor 52 is provided in connection with the paper absence detection lever 51. The paper absence sensor 52 is comprised of a light emitting element and a light receiving element for receiving light emitted from the light emitting element. A light interrupting segment 53 is integrally formed with the paper absence detection lever 51. This light interrupting segment 53 has the function of interrupting light sent from the light emitting element to the light receiving element of the paper absence sensor 52, being positioned between them when there are paper sheets stacked on the paper feed table 10. The paper feed table 10 is provided with a hole 54 defined at a position opposite to the tip portion of the paper absence detection lever 51 so that the tip portion can be fitted into the hole 54.

When there are paper sheets on the paper feed table 10, the paper absence detection lever 51, which projects over the paper sheets on the paper feed table 10 during paper feeding like the pick-up rollers 38*a*, 38*b* etc., is prevented from pivoting downwards by its own weight because the stack of paper sheets prevents its tip portion from being fitted into the hole 54. This allows the light interrupting segment 53 of the paper absence detection lever 51 to remain between the light emitting element and the light receiving element of the paper absence sensor 52. When the paper sheets on the paper feed table 10 run out, the paper absence detection lever 51 pivots downwards owing to its own weight about the axis of the first rotary shaft 35 because no paper prevents the tip portion from fitting into the hole 54. As a result, the tip portion fits in the hole 54 defined in the paper feed table 10, causing the light interrupting segment 53 to move from the position between the light emitting element and the light receiving element of the paper absence sensor 52, whereby it is detected that there exists no paper sheet on the paper feed table 10.

(c) Feeding level detector

The first rotary shaft 35 is also provided with a feeding level detection lever 55 and a feeding level detection release lever 56. Those levers 55, 56 are away from the paper feed table 10 rightward with respect to the paper feeding direction b. More specifically, the feeding level detection lever 55 is supported at the centre thereof so as not to rotate forwardly and backwardly in relation to the first rotary shaft 35, whilst the feeding level detection release lever 56 is supported at the centre thereof so as to rotate forwardly and backwardly in relation to the same. On the downstream side of the feeding level detection lever 55 with respect to the paper feeding direction b, there is provided a feeding level sensor 57 composed of a light emitting element and a light receiving element for receiving light emitted from the light emitting element. When the top sheet of the paper sheets 5 stacked on the paper feed table 10 is at the feeding level X, a piece 58 formed at one end of the feeding level detection lever 55 is positioned between the light emitting element and the light receiving element of the feeding level sensor 57. On the downstream side of the feeding level detection release lever 56 with respect to the paper feeding direction b, there is provided a tension coil spring 59 for energizing the feeding level detection release lever 56 to pivot in a direction indicated by the arrow f of FIG. 4. On the upstream side of the feeding level detection release lever 56 with respect to the paper feeding direction b, there is provided an interlocking piece 60 integrally formed with the feeding level detection release lever 56. When the tension coil spring 59 causes the pivoting of the feeding level detection release lever 56 in the direction of the arrow f, the interlocking piece 60 comes in contact with the underside of one end of the feeding level detection lever 55 to be interlocked therewith in order to raise the feeding level detection lever 55 in the direction of the arrow f. The feeding level detection release lever 56 is connected, at the downstream side thereof, to a plunger 61 which is actuated only during paper feeding and during feeding level detection and releases the feeding level detection release lever 56 from the interlocking with the feeding level detection lever 55 by rotating the feeding level detection release lever 56 against the energizing force of the tension coil spring 59 in the direction opposite to the direction of the arrow f.

When the plunger 61 is not operative (i.e., during a time when neither paper feeding nor feeding level detection is executed), the tension coil spring 59 energizes the feeding level detection release lever 56 to pivot so that the feeding level detection lever 55 is interlocked with the interlocking piece 60 of the feeding level detection release lever 56 and is raised in the direction of the arrow f as shown in the drawings. Then, the pick-up rollers 38*a*, 38*b* etc. are raised by the first rotary shaft 35 so that they are suspended above the top sheet of the paper sheets 5 stacked on the paper feed table 10. On the other hand, when the plunger 61 is operative (i.e., during paper feeding or during feeding level detection), the feeding level detection lever 55 is released from its raised condition, the raising being resulted from the interlocking by the interlocking piece 60 of the feeding level detection release lever 56. Then, the pick-up rollers 38*a*, 38*b* are brought into contact with the top sheet of the paper sheets 5 on the paper feed table 10 from above because of their own weight. At that time, if the piece 58 formed at one end of the feeding level detection lever 55 is positioned between the light emitting element and the light receiving element of the feeding level sensor 57, it is detected that the top sheet is at the feeding level X, and if not, it is detected that the top sheet is not at the feeding level X.

Figure 5:
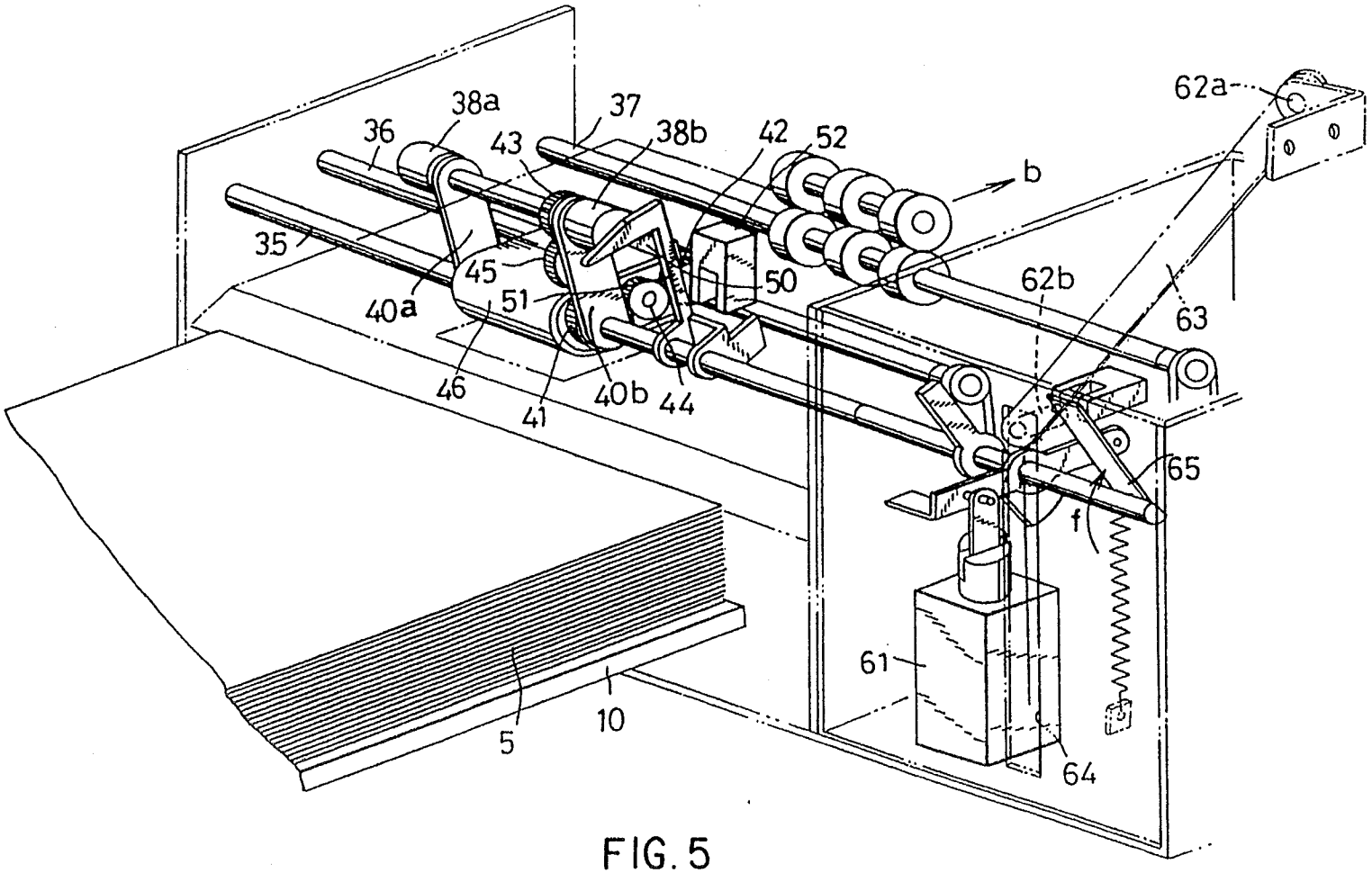
FIG. 5 is a view illustrating an action when the openable cover shown in FIG. 4 is opened.

There is a link 63 interposed between the casing 6 and the openable cover 7. The link 63 has projections 62*a*, 62*b* at both ends of one side face thereof, and is pivotally supported on the openable cover 7 with the projection 62*a*. The projection 62*b* is loosely inserted into a guide groove 64 defined in a vertical direction in the casing 6 in such a manner that: as the openable cover 7 is opened, the projection 62*b* is guided to move upwards from the lower part of the guide groove 64; and as the openable cover 7 is closed, the projection 62*b* is guided to move downwards from the upper part of the guide groove 64. The first rotary shaft 35 is provided with a flipping board 65 secured at the end thereof, the end being situated at the right hand with respect to the paper feeding direction b. As shown in FIG. 5, in the course of the upward movement of the projection 62*b* through the guide groove 64, the flipping board 65 is flipped upwards by the projection 62*b* as the projection 62*b* moves upwards, with the result that the first rotary shaft 35 rotates in the direction of the arrow f.

Accordingly, the first rotary shaft 35 is rotated in the direction of the arrow f concomitantly with the opening of the openable cover 7. This rotation is transmitted to the pick-up rollers 38*a*, 38*b* through the supporting arms 40*a*, 40*b* and to the paper absence detection lever 51 engaged with the supporting arm 40*b*, so that the pick-up rollers 38*a*, 38*b* and the paper absence detection lever 51 pivot upwards about the axis of the first rotary shaft 35. As a result, the pick-up rollers 38*a*, 38*b* and the paper absence detection lever 51 are retracted from their respective positions above the paper feed table 10, which facilitates the operation of loading paper sheets onto the paper feed table 10 from above. The opening of the openable cover 7 turns an interlock switch off, thereby bringing the sensors and driving motors etc. into their inoperative conditions.

The invention applied to a paper feeder of the separation type which is installed separately from an electrophotographic device body has been particularly described hereinabove, but it is obvious that the invention may be applied to a paper feeder integral with an electrophotographic device body.

Although the above embodiment employs two pairs of pulleys 17*a* to 17*d* (17*a*' to 17*d*') provided at each of the sides (situated at the right and left of the paper feeding direction b) of the paper hopper, the pulleys in each pair being vertically aligned, and the two pairs being arranged along the paper feeding direction b, the invention is not necessarily limited to this. Alternatively, three pairs of pulleys may be provided on both sides. Further, four pairs of pulleys or more may be provided on both sides.

The paper feed table 10 is held horizontal by the use of a pair of endless rubber belt 24, 24' in the above embodiment, but it is also possible to adopt such an arrangement that one endless rubber belt is used and a common rotary shaft is provided for a pair of opposite pulleys, for example, the pulleys 17*b*, 17*b*'.

The endless wire ropes 18, 18' employed in the embodiment may be extended in the form of a ring, or wire ropes each of which is connected at the projections 16 (16') of the paper feed table 10 may be used. Instead of the endless wire ropes 18, 18', endless fabric ropes may be used. Although the endless rubber belt 24, 24' are employed in the embodiment, endless chains can be employed instead of those belts.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper feeder comprising:

(a) an opening section having an upper part which is openable when the paper feeder is in a paper feeding state during which paper sheets are picked up and fed;

(b) a paper feed table disposed below said opening section which can be lifted to the opening section or lowered therefrom while being held horizontal and onto which the paper sheets are loaded from above through the opening section; and (c) a pick-up member for picking up the paper sheets stacked on the paper feed table one after another for feeding, starting with a top sheet.

2. The paper feeder as claimed in claim 1, wherein at least a part of the pick-up member projects to a position above the paper sheets stacked on the paper feed table, and is retractable therefrom.

3. The paper feeder as claimed in claim 2, wherein the retraction of the part of the pick-up member from the position above the paper feed table is done, by allowing the part to pivot upwardly about an axis located on a side of the paper feed table.

4. The paper feeder as claimed in claim 2, wherein a paper presence/absence detector has at least a part which projects to a position above the paper sheets stacked on the paper feed table, for detecting the presence/absence of paper sheets stacked on the paper feed table and said part is retractable from said position concomitantly with the retraction of the part of the pick-up member from the position above the paper feed table.

5. The paper feeder as claimed in claim 4, wherein the retraction of the part of the paper presence/absence detector from the position above the paper feed table is done by allowing the part of the paper presence/absence detector to pivot about an axis located on the side of the paper feed table, being engaged with the part of the pick-up member which pivots upwardly about the axis.

6. The paper feeder as claimed in claim 1, wherein the opening section is provided with an openable cover.

7. The paper feeder as claimed in claim 1, wherein at least a part of the pick-up member projects to a position above the paper sheets stacked on the paper feed table, and is retractable therefrom concomitantly with opening of an openable cover provided at the opening section.

8. The paper feeder as claimed in claim 7, wherein the retraction of the part of the pick-up member from the position above the paper feed table is done in such a way that a shaft located on a side of the paper feed table and adapted to support at least the part of the pick-up member so as not to rotate forwardly and backwardly is rotated concomitantly with opening of the openable cover so that a link mechanism allows the part of the pick-up member to pivot upwardly about the axis of the shaft.

9. The paper feeder as claimed in claim 2 or 7, wherein the part of the pick-up member is a pick-up roller.

10. The paper feeder as claimed in claim 7, wherein a paper presence/absence detector has at least a part which projects to a position above the paper sheets stacked on the paper feed table, for detecting the presence/absence of paper sheets stacked on the paper feed table and said part is retractable from said position concomitantly with the retraction of the part of the pick-up member from the position above the paper feed table, the retraction of the part of the pick-up member being concomitant with opening of the openable cover.

11. The paper feeder as claimed in claim 10, wherein the retraction of the part of the paper presence/absence detector from the position above the paper feed table is done in such a way that a shaft located on a side of the paper feed table and adapted to support the part of the paper presence/absence detector so as to rotate forwardly and backwardly and the part of the pick-up member so as not to rotate forwardly and backwardly is rotated concomitantly with opening of the openable cover so that a link mechanism allows the part of the pick-up member to pivot upwardly about the axis of the shaft together with the part of the paper presence/absence detector engaged with the upwardly pivoting part of the pick-up member.

12. The paper feeder as claimed in claims 4 or 10, wherein the part of the paper presence/absence detector is a paper absence detection lever which pivots downwardly so that its tip portion is fitted into a hole defined at the paper feed table when there is no paper sheet stacked on the paper feed table, and the part of the pick-up member is a pick-up roller.

13. A paper feeder, wherein paper sheets stacked on a paper feed table are picked up one after another for feeding, starting with a top sheet, comprising:

(a) holding means for holding the paper feed table such that the paper feed table can be lifted or lowered being held horizontal;

(b) feeding level maintaining means for lifting the paper feed table held horizontal by the holding means, for paper feeding, such that the top sheet of the paper sheets stacked on the paper feed table is kept at a predetermined feeding level; and (c) loading level maintaining means for lowering the paper feed table held horizontal by the holding means, for loading, such that when there is no paper sheet stacked on the paper feed table, the paper feed table is kept at a predetermined loading level that is lower than the predetermined feeding level; and such that when paper sheets are stacked on the paper feed table, the top sheet of the paper sheets is kept at the loading level, whereby paper sheets to be replenished can be loaded onto the paper feed table at the loading level.

14. The paper feeder as claimed in claim 13, wherein an opening section is provided, the opening section being openable at the upper part thereof when the paper feeder is in a paper feeding state during which the paper sheets are picked up and fed, and through the opening section, paper sheets are loaded from above; and wherein when there is no paper sheet on the paper feed table, paper sheets are loaded onto the paper feed table kept at the predetermined loading level by the loading level maintaining means; and when there are paper sheets stacked on the paper feed table, paper sheets are loaded onto the top sheet of the stacked paper sheets. The top sheet being kept at the predetermined loading level by the loading level maintaining means.

15. The paper feeder as claimed in claim 14, wherein the opening section is provided with an openable cover.

16. The paper feeder as claimed in any one of claims 13 to 15, wherein the holding means has an endless rope at least on each of opposite sides of the paper feed table, each of the endless ropes being extended in figure-of-eight fashion so as to form vertical portions on a plane parallel with an ascending/descending plane of the paper feed table; and wherein the paper feed table is suspended in a horizontal condition, being secured to the vertical portions of the respective endless ropes thus extended, whereby the paper feed table is so supported as to be lifted or lowered being held horizontal.

17. The paper feeder as claimed in claim 16, wherein the endless ropes are wound around a plurality of pairs of pulleys disposed on the respective sides of the paper feed table in figure-of-eight fashion, the pulleys in each pair being aligned vertically and the pairs being aligned along both of the sides.

18. The paper feeder as claimed in any one of claims 13 to 15, wherein the feeding level maintaining means comprises (a) belt member extended on a side of the paper feed table in the ascending/descending directions thereof and including an engaging member which is brought into engagement with the underside of the paper feed table and (b) a driving mechanism for driving the belt member in the ascending/descending directions of the paper feed table; and wherein for paper feeding, the driving mechanism actuates the belt member, with the engaging member of the belt member being engaged with the underside of the paper feed table in order to lift the paper feed table such that the top sheet of the paper sheets stacked thereon is maintained at the predetermined feeding level.

19. The paper feeder as claimed in claim 18, wherein the belt member is an endless rubber belt which is wound around a pair of pulleys, the pulleys being vertically aligned on the side of the paper feed table.

20. The paper feeder as claimed in any one of claims 13 to 15, wherein the loading level maintaining means comprises an elastic member for imparting an elastic tension force in the ascending direction of the paper feed table; and wherein for loading, the paper feed table is lowered against the elastic tension force of the elastic member as paper sheets are loaded, such that when there is no paper sheet on the paper feed table, the paper feed table is kept at the predetermined loading level and such that when there are paper sheets stacked on the paper feed table, the top sheet of the paper sheets is kept at the predetermined loading level.

21. The paper feeder as claimed in claim 20, wherein the elastic member is a tension coil spring.

22. The paper feeder as claimed in any one of claims 6, 7 or 15, wherein the openable cover is a two-foldable cover.

23. The paper feeder as claimed in claim 22, wherein the two-foldable cover is composed of a first half cover and a second half cover which are engaged with each other at their first sides so as to pivot about an axis extending along the first sides; and wherein the second half cover is engaged with the main body of the paper feeder at a second side thereof which is opposite to the first side, such that the second side can pivot about an axis extending along the second side.

24. The paper feeder as claimed in claim 23, wherein the two-foldable cover is designed such that for opening the two-foldable cover, the first half cover is raised and then moved towards the second half cover in such a manner that a second side of the first half cover opposite to the first side slides on an end face of the main body of the paper feeder so that the rear face of the first half cover comes to face to the rear face of the second half cover.

25. The paper feeder as claimed in claim 23, wherein the two-foldable cover is designed such that when the two-foldable cover is in its opening state, the second half cover stands substantially upright being prevented from pivoting in the cover-opening direction in relation to the main body of the paper feeder, whilst the first half cover inclines in the cover-opening direction and leans against the second half cover being supported at the first side thereof so that the opening state can be maintained.

26. The paper feeder as claimed in claim 23 wherein the first and second half covers have the same configuration and are disposed symmetrically, being pivotally engaged with each other.

* * * * *